US008287938B1

(12) United States Patent
Scheer

(10) Patent No.: US 8,287,938 B1
(45) Date of Patent: Oct. 16, 2012

(54) METHOD TO PRODUCE A COATING AND TO FINE-TUNE THE COATING MORPHOLOGY

(76) Inventor: Ingo Scheer, La Jolla, CA (US)

( * ) Notice: Subject to any disclaimer, the term of this patent is extended or adjusted under 35 U.S.C. 154(b) by 529 days.

(21) Appl. No.: 12/469,661

(22) Filed: May 20, 2009

Related U.S. Application Data

(60) Provisional application No. 61/054,475, filed on May 20, 2008.

(51) Int. Cl.
*B05D 1/12* (2006.01)
*B05D 1/00* (2006.01)

(52) U.S. Cl. ..... 427/2.1; 427/195; 427/427.5; 239/9

(58) Field of Classification Search ..... 427/2.1–2.31
See application file for complete search history.

(56) References Cited

U.S. PATENT DOCUMENTS 3,067,948 A * 12/1962 Lang et al. ..... 239/4
3,840,391 A * 10/1974 Spitz et al. ..... 427/565
3,949,096 A * 4/1976 Johnson et al. ..... 426/302
4,421,798 A * 12/1983 Lin ..... 427/209
4,473,185 A * 9/1984 Peterson et al. ..... 239/8
4,507,377 A * 3/1985 Alexandrovich ..... 430/115
5,989,638 A * 11/1999 Nielsen ..... 427/331
7,504,125 B1 * 3/2009 Pacetti et al. ..... 427/2.24
7,892,593 B2 * 2/2011 Scheer ..... 427/2.1
2002/0018815 A1 * 2/2002 Sievers et al. ..... 424/489
2002/0150669 A1 * 10/2002 Pui et al. ..... 427/2.1
2003/0131844 A1 * 7/2003 Kumar et al. ..... 128/200.24
2003/0143315 A1 * 7/2003 Pui et al. ..... 427/2.1
2003/0228240 A1 * 12/2003 Dwyer ..... 422/99
2004/0071892 A1 * 4/2004 Walter et al. ..... 427/421
2004/0140374 A1 * 7/2004 Snyder et al. ..... 239/418
2006/0065755 A1 * 3/2006 Sugita et al. ..... 239/1
2007/0231457 A1 * 10/2007 Pham et al. ..... 427/2.1
2008/0054100 A1 * 3/2008 Rosell et al. ..... 239/337
2008/0195079 A1 * 8/2008 Moore et al. ..... 604/500
2008/0305420 A1 * 12/2008 Kinoshita et al. ..... 430/97
2010/0075019 A1 * 3/2010 Scheer ..... 427/2.25

* cited by examiner

*Primary Examiner* — Randy Gulakowski
*Assistant Examiner* — Brieann R Fink

(57) ABSTRACT

This invention relates to a method to produce reproducible and homogeneous coatings and to fine-tune the coating morphology. More particularly, the invention relates to a method and apparatus for controlling the particle formation and deposition process to form a biocompatible coating on a medical implant or a tissue.

20 Claims, 7 Drawing Sheets

METHOD TO PRODUCE A COATING AND TO FINE-TUNE THE COATING MORPHOLOGY

CROSS-REFERENCE TO RELATED APPLICATIONS

This Application claims priority from U.S. 61/054,475 filed on May 20, 2008.

FEDERALLY SPONSORED RESEARCH

Not Applicable

SEQUENCE LISTING OR PROGRAM

Not Applicable

BACKGROUND OF THE INVENTION

This invention relates to finely atomizing fluid compositions to produce reproducible and homogeneous coatings in the nano-micrometer range on substrates. More particularly, this invention relates to a method and apparatus for controlling the particle formation and deposition process to form a biocompatible coating in-situ on a medical implant or a tissue surface of a mammal.

Fluid compositions comprising one or more therapeutic substances, one or more volatile solvents and film-forming components can be deposited on a medical device or a tissue. For example, coatings are often applied to medical implants, such as arterial stents, to improve the biocompatibility of the implants and/or deliver a therapeutic substance to a target surface. Other applications include coating a tissue surface of a living body with a therapeutic substance, such as a cell suspension of cultured epidermal cells, to enhance wound healing, adhering cells or depositing a therapeutic substance in the nasal cavity or lung to treat a disease.

Known processes generally do not ensure a controlled and reproducible film formation in the nano-micro range as well as precise control of the surface features resulting in decreased biocompatibility of the film. Problems include, among others, by excessive amounts of residual solvents and other additives, decreased potency of sensitive therapeutic substances, insufficient control of drug load and drug release, uneven distribution of therapeutic substances and/or poor control of the coating morphology.

OBJECT OF THE INVENTION

Accordingly, there is a need for a process and apparatus that will not only ensure the uniformity of a coating but also allow for improved control of the particle formation and deposition process.

It is therefore an object of the invention to reproducibly generate homogenous coatings on a substrate at low temperatures to retain the potency of beneficial agents.

Still another object is to minimize solvent residuals and fine-tune the morphology of the coating for the particular application.

Yet another object is to alter drug load and drug diffusion and to ensure improved adhesion and embedding of cells by manipulating the surface features and drug particle morphology.

A further object is to obtain high coating transfer efficiency while ensuring a homogeneous coating thickness on the entire surface and particularly on hard to reach areas of a medical implant or a tissue surface.

These and additional features and advantages of the invention will be more readily apparent upon reading the following description of exemplary embodiments of the invention and upon reference to the accompanying drawings herein.

SUMMARY OF THE INVENTION

The invention provides a versatile spraying process and apparatus for the controlled particle formation and deposition on a medical device or a tissue surface to form a coating. The coatings may include one or more non-volatile components like film-forming and therapeutic substances and at least a volatile component for dissolving the non-volatile materials, reducing viscosity, and providing a carrier medium for dispersions. Coatings formed by the process of the invention can be fine-tuned during the spraying process to exhibit different properties according to the particular requirements. For example, the porosity, the roughness and the total surface area of the coating can be varied. The mass diffusion rates through the surface may be controlled by either increasing or decreasing the surface area of the coating and the porosity.

A method is provided to form a coating on a substrate and to fine-tune the coating morphology. The method comprises the steps of (a) providing a first liquid composition including at least a volatile component and at least a non-volatile component; (b) providing at least an atomizing device having a first conduit for flowing said first liquid composition from a first liquid inlet to a first orifice and a second conduit for flowing a first gas stream from a second inlet to a second orifice; (c) atomizing the liquid composition so that droplets having an initial median droplet size of less than four microns are produced from the volatile component and particles are formed from the non-volatile component of the liquid composition; (d) modifying the coating morphology of the coating by adjusting the amount of submicron sized droplets formed from the volatile component in immediate vicinity of the substrate; and (e) depositing the particles on the substrate to form a coating with a desired morphology.

In one or more embodiments, at least 20% of the droplets of the volatile component may be submicron sized, the amount of submicron sized droplets may be adjusted by varying the distance between the atomizing device and the substrate, and the first liquid composition may comprise a therapeutic substance.

In another embodiment, the method may further comprise the steps of: (a) providing at least an additional conduit for a second gas stream and heating means; (b) heating said second gas stream and flowing it from said additional conduit to a third orifice; (c) directing said second gas stream so that it interacts with the first gas stream and increases the temperature of the first gas stream to a temperature higher than ambient temperature; and (d) adjusting the amount of submicron sized droplets by varying the temperature and/or flow rate of the second gas stream. The third orifice of the additional conduit may at least partially surround the first and second conduits and the emerging gas stream is preferably inclined towards the first gas stream so that the heat transfer between the first and second gas streams is optimized.

In still another embodiment, the method may furthermore comprise the steps of: (a) providing at least an additional conduit; (b) flowing a second liquid from an inlet to an outlet of said additional conduit; (c) atomizing said second liquid into fine particles; and (d) embedding the particles from the second liquid in the coating. The second liquid may comprise a therapeutic substance and the non-volatile component a polymeric substance.

In a further embodiment, the method may further comprise the steps of: (a) inducing swirl motion in the first gas stream to obtain a vortical gas flow; (b) transporting the particles to the substrate so that the majority of the particles have a tangential velocity component in relation to the surface of the substrate and an asymmetric splat morphology is produced upon deposition on the substrate.

In one or more embodiments, the first liquid composition is preferably flown at a constant velocity from the first liquid inlet to the first liquid outlet, the velocity of the first gas stream may exceed sonic speed, and the first liquid composition may be heated. The substrate can generally be a medical device or a tissue of a living body.

In an additional embodiment, the coating may consist of several layers that comprise pores and it may have a three-dimensional structure. The pores are preferably interconnected so that beneficial agents or cells can penetrate through the coating layer. The coating can comprise surface features having a size smaller than 20 microns that may increase the intrinsic hydrophobicity and/or hydrophilicity of the coating.

In one or more embodiments, the produced coating can be applied to a patient to promote wound healing and may comprise at least a porous layer with a therapeutic agent.

BRIEF DESCRIPTION OF THE SEVERAL VIEWS OF THE DRAWINGS

The accompanying drawings, which are incorporated herein and form a part of the specification, illustrate the embodiments of the present invention and together with the description, serve to explain the principles of the invention. In the drawings.

DETAILED DESCRIPTION

Figure 1A:
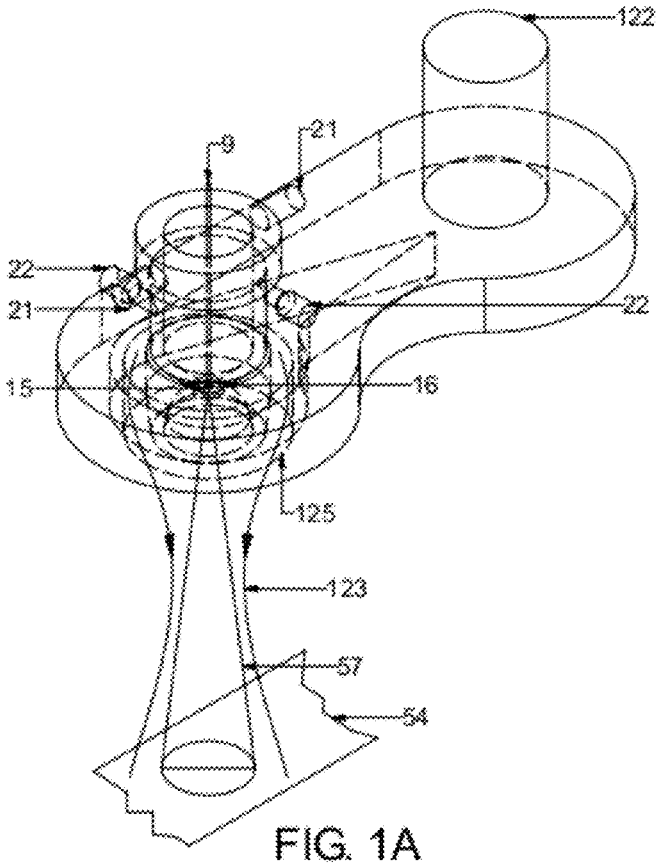
FIG. 1A is a schematic representation of the apparatus and method of the present invention.

Further aspects of the invention will become apparent from consideration of the drawings and the ensuing description of preferred embodiments of the invention. A person skilled in the art will realize that other embodiments of the invention are possible and that the details of the invention can be modified in a number of respects, all without departing from the inventive concept. Thus, the following drawings and description are to be regarded as illustrative in nature and not restrictive. Features and advantages of the present invention, as well as the structure and operation of various embodiments of the present invention, are described in detail below with reference to the accompanying drawings.

A method is provided to form a coating on a substrate and fine-tune the coating morphology. The method comprises the steps of: (a) providing a first liquid composition including at least a volatile component and at least a non-volatile component; (b) providing at least an atomizing device having a first conduit for flowing said first liquid composition from a first liquid inlet to a first orifice and a second conduit for flowing a first gas stream from a second inlet to a second orifice; (c) atomizing the liquid composition so that droplets having an initial median droplet size of less than four microns are produced from the volatile component and particles are formed from the non-volatile component of the liquid composition; (d) modifying the coating morphology of the coating by adjusting the amount of submicron sized droplets formed from the volatile component in immediate vicinity of the substrate; and (e) depositing the particles on the substrate to form a coating with a desired morphology.

The substrate is generally a medical device or the tissue surface of a mammal including, without limitation, the skin, basal structure of a wound, the nasal cavity, and lung. A "medical device", as used herein, refers to a device having surfaces that contact tissue, blood, or other bodily fluids of patients. Exemplary medical devices include: extracorporeal devices for use in surgery such as blood oxygenators, blood pumps, blood sensors, tubing used to carry blood and the like; prostheses implanted in a human or animal body such as vascular grafts, stents, pacemaker leads, and heart valves; devices for temporary intravascular use such as catheters, guide wires; and ophthalmic devices including contact lenses, intraocular lenses or stents used in ocular vicinity.

The non-volatile component preferably includes biocompatible film-forming agents and optionally beneficial agents. The film forming agents should have a sufficiently high molecular weight, glass transition temperature and non-volatile fraction to allow the formation of solid particles by solvent evaporation when sprayed and film formation on a substrate. The glass transition temperature should be preferably above 30 degrees C. In general, the average size of the particles can be controlled by adjusting the fluid concentration, the solvent level and the operating parameters of the spraying device. The non-volatile fraction should generally be between 0.1 to 10 percent by weight. Examples of suitable biocompatible film-forming agents include, but are not limited to, synthetic polymers including polyethylen (PE), poly (ethylene terephthalate), polyalkylene terepthalates such as poly(ethylene terephthalate) (PET), polycarbonates (PC), polyvinyl halides such as poly(vinyl chloride) (PVC), polyamides (PA), poly(tetrafluoroethylene) (PTFE), poly(methyl methacrylate) (PMMA), polysiloxanes, ethylene-vinyl acetate (EVAc), polyurethane polysiloxanes, and poly(vinylidene fluoride) (PVDF); biodegradable polymers such as poly(glycolide) (PGA), poly(lactide) (PLA) and poly(anhydrides) polylactic-co-glycolic acid) (PLGA), PEG-PLA-PEG, PEG-PLGA-PEG, PEG-PCL-PEG, PLA-PEG-PLA, PHB, P(PF-co-EG) ±acrylateend groups, P(PEG/PBO terephthalate), PEG-bis-(PLA-acrylate), PEG6CDs, PEG-g-P(AAm-co-Vamine), PAAm, P(NIPAAm-co-AAc), P(NIPAAm-co-EMA), PVAc/PVA, PNVP, P(MMA-co-HEMA), P(AN-co-allylsulfonate), P(biscarboxy-phenoxy-phosphazene), P(GEMA-sulfate); natural polymers and their derivatives including HA, alginic acid, pectin, carrageenan, chondroitin sulfate, dextrane, sulfate, chitosan, polylysine, collagen, gelatin, carboxymethyl chitin, chitosan, fibrin, collagen, dextran, agarose, pullulan, sclerogluan, cellulose, albumin, silk; and combinations of natural and synthetic polymers including P(PEG-co-peptides), alginate-g-(PEO-PPO-PEO), P(PLGA-co-serine), collagen-acrylate, alginate-acrylate, P(HPMA-g-peptide), P(HEMA/Matrigel), HA-g-g-NIPAA. Alternatively or in addition, biocompatible mineral, vegetable or animal oils may be used including fish oil, cod-liver oil, olive oil, linseed oil, sunflower oil, corn oil, and/or palm oil.

The term "beneficial agent", as used herein, is intended to have its broadest possible interpretation and is used to include any therapeutic substance, active agent or drug (e.g., pharmaceutical) that is delivered to the body of a living being to produce a desired beneficial effect. The beneficial agent may include, but is not limited to proteins, hormones (e.g., growth factors), vitamins, anti-microbacterial agents, antioxidants, DNA, antimetabolite agents, anti-inflammatory agents, anti-restenosis agents, anti-thrombogenic agents, antibiotics, anti-platelet agents, anti-clotting agents, chelating agents, or antibodies. Specific examples include hyaluronic acid (HA), omega-3 fatty acids (DHA/EPA), acetylsalicylic acid, dexamethasone, M-prednisole, interferon y-1b, Leflunomide, sirolimus, tacrolimus, everolimus, mizoribine, ABT-578, QP-2, actinomycin, methothrexate, angiopeptin, vincristine, mitomycine, statins, PCNA Ribozyne, Batimastat, Prolyl hydroxylase inhibitors, C-proteinase inhibitors, Probucol, Re-Endothelialization, BCP671, VEGF Estradiols, NO donors, EPC antibodies; antioxidants such as probucol and retinoic acid; angiogenic and anti-angiogenic agents; agents blocking smooth muscle cell proliferation such as rapamycin, angiopeptin, and monoclonal antibodies capable of blocking smooth muscle cell proliferation; anti-inflammatory agents such as dexamethasone, prednisolone, corticosterone, budesonide, estrogen, sulfasalazine, acetyl salicylic acid, and mesalamine, lipoxygenase inhibitors; calcium entry blockers such as verapamil, diltiazem and nifedipine; antineoplastic/antiproliferative agents such as paclitaxel, methotrexate, doxorubicin, daunorubicin, cyclosporine, cisplatin, vinblastine, vincristine, colchicine, epothilones, endostatin, angiostatin, Squalamine, and thymidine kinase inhibitors; L-arginine; antimicrobials such as triclosan, cephalosporins, aminoglycosides, and nitorfuirantoin; anesthetic agents such as lidocaine, bupivacaine, and ropivacaine; anticoagulants such as D-Phe-Pro-Arg chloromethyl ketone, heparin, anti-thrombin compounds, anti-thrombin antibodies, anti-platelet receptor antibodies, aspirin, prostaglandin inhibitors, platelet inhibitors; vascular cell growth promoters such as growth factors, growth factor receptor antagonists, transcriptional activators, and translational promoters; vascular cell growth inhibitors such as growth factor inhibitors, growth factor receptor antagonists, transcriptional repressors, translational repressors, replication inhibitors, inhibitory antibodies, antibodies, directed against growth factors; and cholesterol-lowering agents. Cells that may be introduced onto a tissue substrate include, without limitation, keratinocytes, fibroblasts, hepatocytes, pancreatic cells, lung cells, muscle cells (smooth, cardiac, striated), chondrocytes, osteoblasts, endothelial cells, fertilized ova, adrenal cells, and neurones.

The volatile component or solvent used for dissolving the film-forming component and the therapeutic substance is selected based on its biocompatibility and solubility of the material to be dissolved. The solvent should be sufficiently fast evaporating. It may perform a variety of functions including dissolving polymers and other non-volatile materials, reducing viscosity, and providing a carrier medium for dispersions. Generally the solvent is at least partially miscible with the non-volatile material. The selection of a particular solvent for a given non-volatile material to obtain desired solubility and dispersibility characteristics is known to those skilled in the art. Aqueous solvents can be used to dissolve water-soluble materials, such as Poly(ethylene glycol) (PEG) and organic solvents may be selected to dissolve hydrophobic and some hydrophilic materials. Examples of suitable solvents include methylene chloride, ethyl acetate, ethanol, methanol, dimethyl formamide (DMF), acetone, acetonitrile, tetrahydrofuran (THF), acetic acid, dimethyle sulfoxide (DMSO), toluene, benzene, acids, butanone, water, hexane, and chloroform, N-methylpyrrolidone (NMP), 1,1,2-trichloroethane (TCE), various freons, dioxane, ethyl acetate, cyclohexanone, and dimethylacetamide (DMAC). For the sake of brevity, the term solvent is used to refer to any fluid dispersion medium whether a solvent of a solution or the fluid base of a suspension.

A film-forming agent and a beneficial agent, also referred to as non-volatile component, may be dissolved or suspended in the same or in separate solvent systems. The non-volatile component may be supplied through a single orifice or through separate orifices as a solution, emulsion, dispersion, or suspension. It may include one or more film-forming or adhesive agents like polymeric substances, oils and/or fats. In addition, plastizers to reduce the glass transition temperature, buffers to adjust the pH of the composition, surfactants to enhance wettability of poorly soluble or hydrophobic materials, radiopaque elements, radioactive isotopes, and the like may be comprised. The amount of drug dissolved will dependent upon the particular drug employed and medical condition being treated. Typically, the drug load may range between 0.001% to about 70%. The coating may be fine-tuned in terms of wettability or surface tension by manipulating the micro-nano structure of the coating in order to produce surfaces having improved wettability (hydrophilicity) and/or reduced wettability (hydrophobicity) also described as "Lotus effect".

It is an important feature of the present invention to disintegrate the volatile component of the composition into fine droplets at comparatively low atomizing pressures and thereby ensuring a satisfactory solvent evaporation and controlled particle deposition on the substrate. This requires a liquid disintegration technique that provides a superior spray performance, namely reproducibly generates small particles having a tight size distribution. The efficiency of the atomization process may be, among others, improved by providing a high-velocity gas stream exceeding sonic velocity to disintegrate the liquid to be sprayed into very fine droplets. The median droplet size of the volatile component should be generally smaller than 6 microns and is preferably less than 4 microns.

The evaporation rate or volatility of a liquid is influenced among others by the vapor pressure. The vapor pressure is the tendency of molecules and atoms to escape from a liquid or a solid, which increases with temperature. A component with a high vapor pressure at normal temperatures is referred to as volatile. The evaporation rate of a liquid augments with increased vapor pressure and decreased droplet or particle size. The vapor pressure increases with increasing curvature of the surface that means with decreased droplet or particle size to be sprayed. Thus, a component with a larger surface area (decreased particle size) will generally evaporate faster as there are more surface molecules which are able to escape. The Kelvin equation describes the increase in the vapor pressure of droplets in a gas medium as a function of their particle size. Model calculations, which were performed by applying the Kelvin equation, show that the vapor pressure increases most significantly for particle or droplet sizes below 4 microns and increases in an exponential manner for submicron sized particles.

A schematic illustration of the coating apparatus and method of the present invention is illustrated in FIG. 1A. Referring to FIG. 1A, an exemplary apparatus comprises a body with a central fluid line extending from fluid inlet 9 to outlet 15. The apparatus includes a first gas conduit that extends to gas orifice 16 for producing a first gas stream and a second gas conduit extending to annular gap 125 for generating a second gas stream. The apparatus is preferably equipped with measuring instruments such as pressure, flow rate, temperature and humidity sensors to allow for improved control of the evaporation process. The apparatus may be furthermore equipped with heating means to heat the second gas stream or depending on the particular application (e.g., spraying of living cells), to maintain the fluid composition at a constant temperature. An anti-clogging liquid (preferably a solvent for the non-volatile fluid) can be fed into the first gas conduit to avoid build-up or clogging of the orifices during the spraying process or during idle times.

In operation, a composition comprising a non-volatile and a volatile component is fed from a fluid supply source (not shown) into fluid inlet 9 and atomizing gas is supplied from a gas supply source (not shown) into gas inlets 21, 22. The gas used to disintegrate the liquid may be pressurized air or suitable inert gases, such as nitrogen. The liquid is preferably fed using a high-accuracy pump to ensure precise control of the liquid supply. The composition is supplied through orifice 15 and the atomizing gas is fed through orifice 16. The composition is atomized and a spray 57 of very fine particles is produced.

Surprisingly, it has been found that the amount of submicron sized droplets produced from the volatile component plays an important role in the rapid formation of coatings having a controlled morphology. An amount of at least 20% submicron droplets, has been found to be advantageous for the production of coatings having a nano-micro structure. In order to produce submicron sized droplets the initial median droplet size of the volatile component should be sufficiently small. The droplets of the volatile component should preferably have a size of less than 4 microns and a tight droplet size distribution should be ensured.

The amount of submicron sized droplets can be fine-tuned by providing a heated second gas stream. The percentage of submicron sized droplets can be adjusted, among others, by varying the temperature and/or flow rate of the second gas stream. The gas flow rate may range between 10 and 300 l/min and the temperature may range between about 60 to 180 degrees C.

Figure 3A:
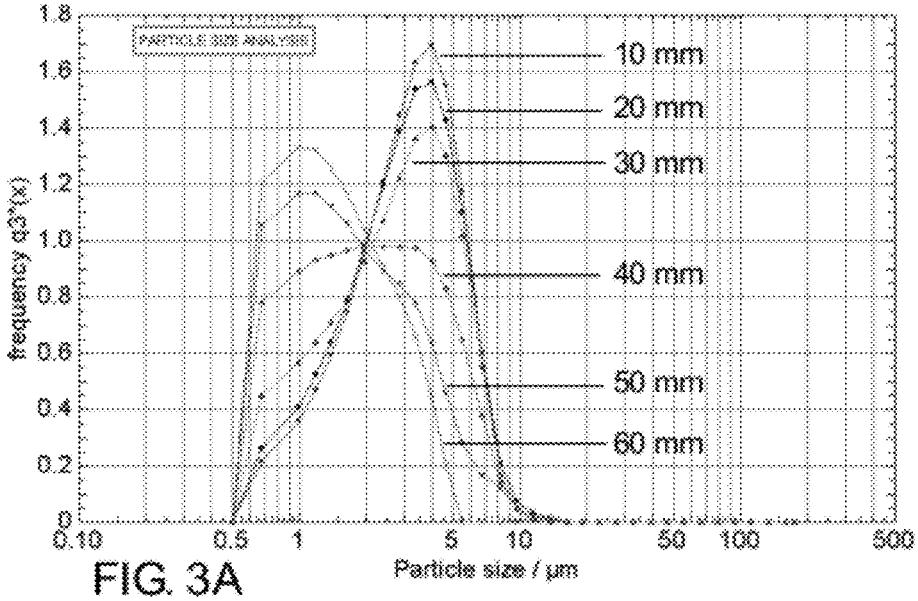
FIG. 3A is a droplet size (density distribution) comparison at various measurement points.

In addition, the distance between the substrate and the spray source can be adjusted to manipulate the submicron droplet amount, as shown in FIG. 3A, and with it the morphology of the coating.

Figure 1B:
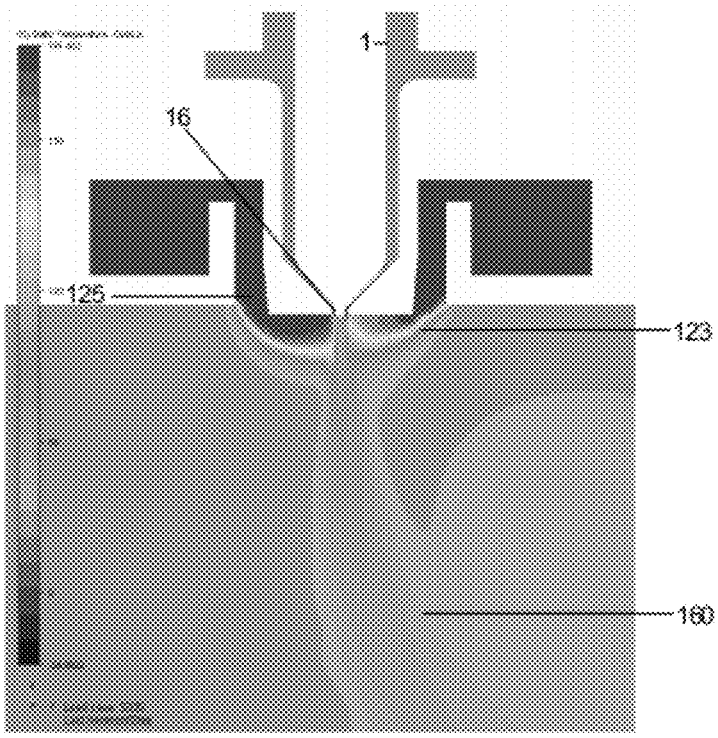
FIG. 1B is a temperature distribution of the apparatus of FIG. 1A.

The heat transfer of the first and second gas flows is visualized using computational fluid dynamics (CFD) depicted in FIG. 1B. The CFD model was calculated with a gas flow rate of 6.8 l/min for the first gas stream of the spray and of 11.2 l/min for the second gas stream and an inlet temperature of 180 degrees C. for the second gas stream. It can be seen that the second gas stream 123 exits from annular gap 125 and interacts with the first gas stream 160 so that the first gas stream is heated above ambient temperature, namely to a temperature of 60 degrees C. The temperature of the first gas stream may range between about 25 to 100 degrees C. depending on inlet temperature and flow rate of the second gas stream. As shown in FIG. 1B, an equal temperature distribution around the annular gap and a controlled microenvironment in vicinity to the atomizing region is obtained. The amount of submicron sized droplets and the evaporation of the volatile component is increased by the second gas stream.

Figure 3B:
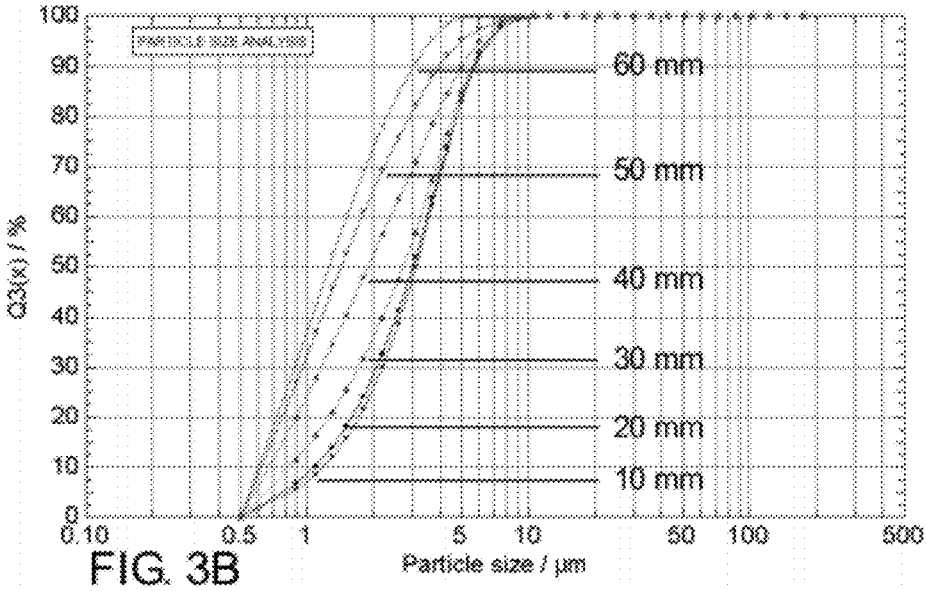
FIG. 3B is a droplet size (cumulative distribution) comparison at various measurement points.

To further enhance the solvent evaporation and produce a desired coating morphology, the particle velocity may be reduced by introducing swirl motion in the gas stream. Thus, the rate of turbulent mixing and the amount of drier external gas that is brought into the spray interior will be increased and the impulse forces of the particles impinging onto the substrate will be influenced, as described in more detail in FIGS. 3B and 4B.

Figure 2A:
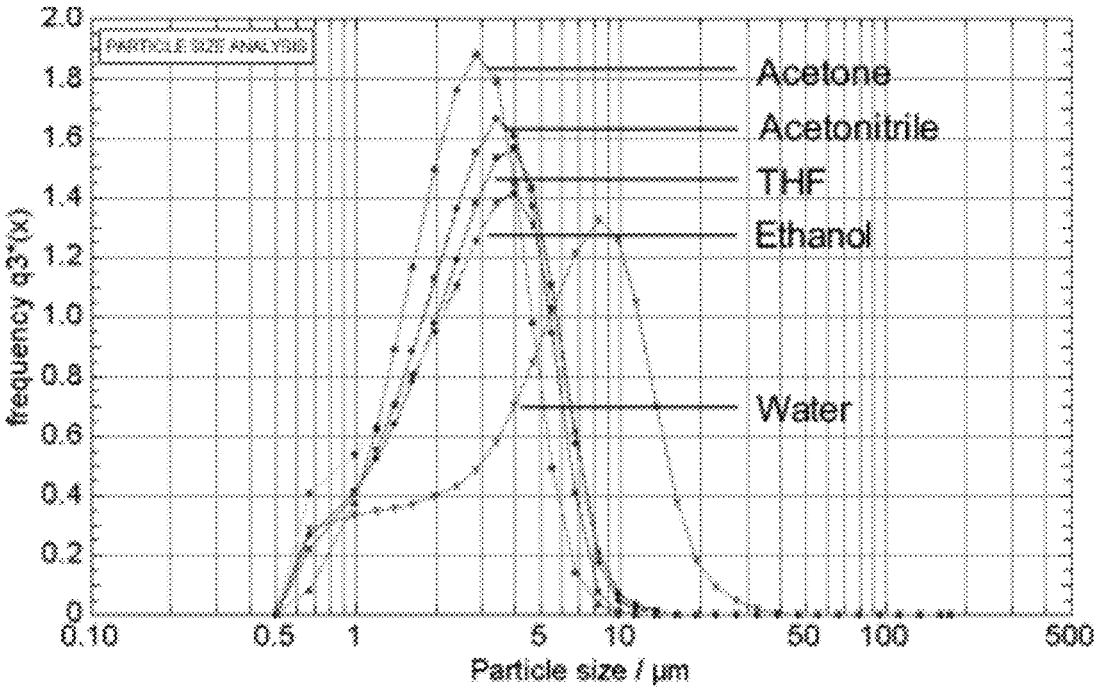
FIG. 2A is a comparison of the initial droplet size (density distribution) of different solvents.
Figure 2B:
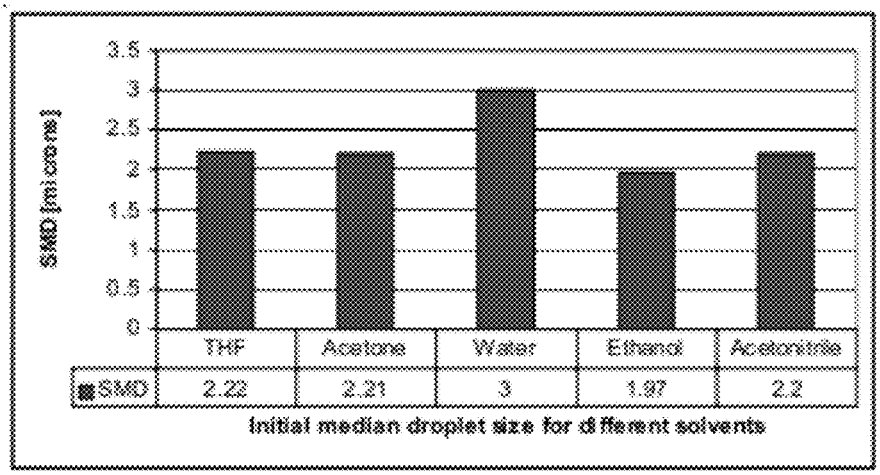
FIG. 2B is a chart visualizing the initial median droplet size (SMD)

FIG. 2A represents a comparison of the droplet (particle) size distribution of the following volatile components obtained with the apparatus of FIG. 1A: Acetone (vapor pressure: 180 mm Hg at 20 degrees C.), acetonitrile (vapor pressure: 80 mm Hg at 20 degrees C.), THF (vapor pressure: 143 mm Hg at 20 degrees C.), Ethanol (vapor pressure: 100 mm Hg at 20 degrees C.) and water (vapor pressure: 17 mm Hg at 20 degrees C.). The solvents were atomized using compressed air at an atomizing pressure of about 1.5 bar. A second gas stream was not produced. The droplet sizes were measured using a Fraunhofer diffraction system (Sympatec, Lawrenceville, USA) at room temperature (about 20 degrees C.) and at a relative humidity of 60%. The droplet sizes were measured in immediate vicinity of the atomizer orifice to obtain the initial droplet size of the solvent. An initial median droplet size (sauter median diameter (SMD)) of 3 microns and less was obtained for the tested solvents. The initial median droplet sizes for the aforementioned solvents are summarized in FIG. 2B.

Figure 3C:
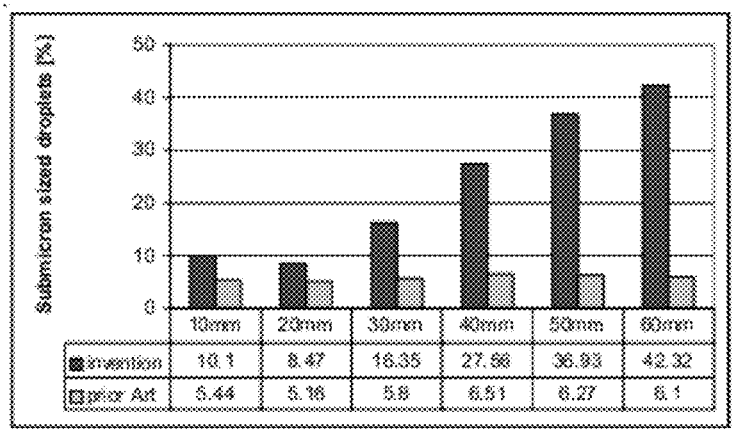
FIG. 3C is a chart visualizing the percentage of submicron droplets.

Another spray test was performed to measure the droplet sizes of the volatile component at various distances from the atomizer tip. Tetrahydrofuran (THF) was sprayed using the apparatus of FIG. 1A at an atomizing pressure of 1 bar and at a gas flow rate of 6 l/min. The tests were conducted at about 20 degrees C. and a relative humidity of 60%. The generated droplet sizes were measured at a distance of 10, 20, 30, 40, 50, and 60 mm downstream from the liquid orifice. A droplet size reduction was surprisingly observed at very small distances. Referring to FIG. 3A, the median droplet size was 3.3 at a distance of 10 mm and 1.59 microns at a distance of 60 mm downstream from the spraying device. To further investigate this phenomenon, the cumulative droplet size distribution was analyzed. The results were compared to the results obtained with a conventional micro spraying nozzle used in the field of stent coating. Referring to FIG. 3C, a steep increase in submicron sized droplets to about 42% was obtained with the apparatus of FIG. 1A and 20% submicron droplets were produced at a distance of only 35 mm. An increase of the percentage of submicron sized droplets could not be obtained using the conventional micro nozzle.

Figure 4:
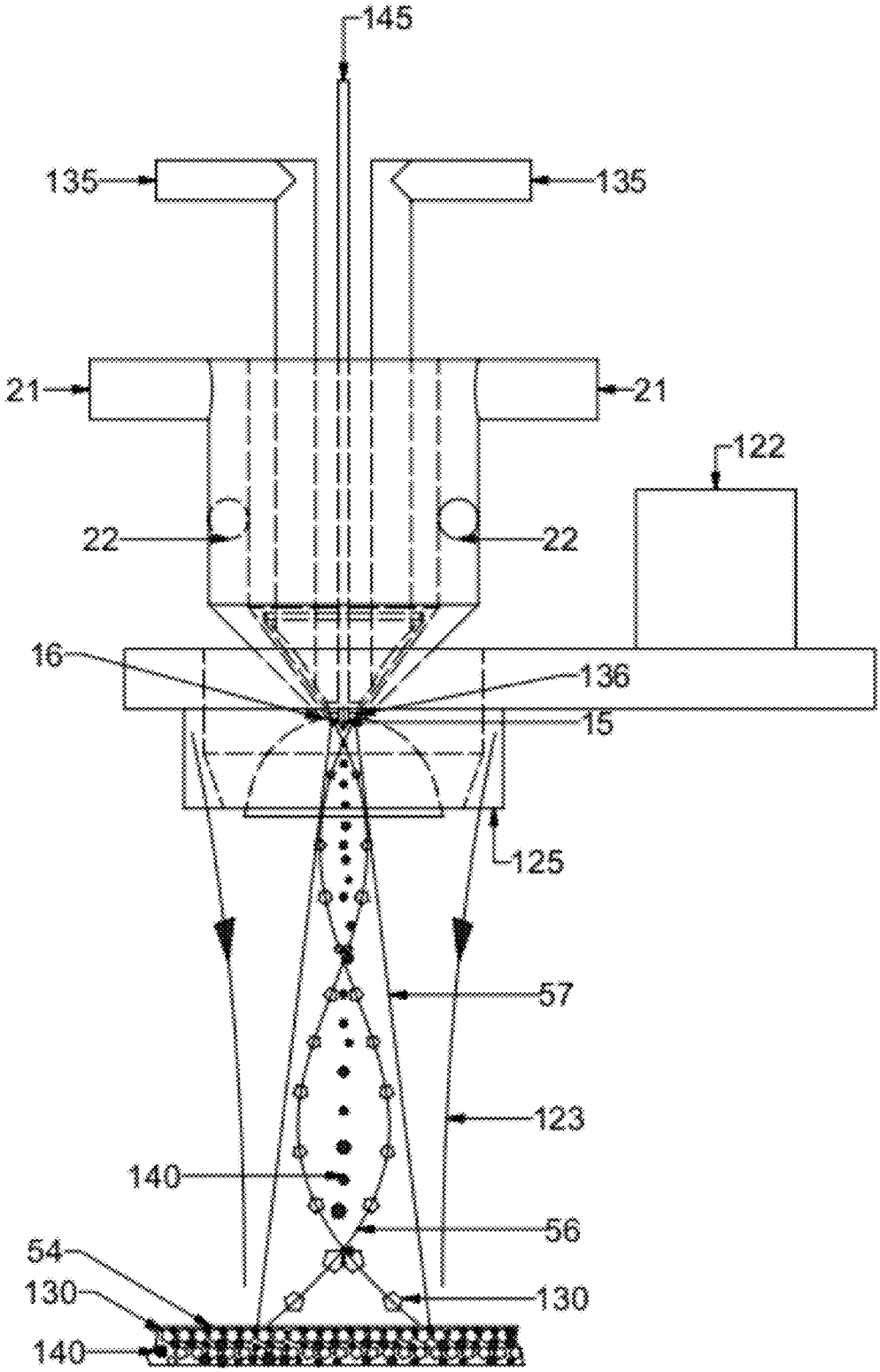
FIG. 4 is an exemplary particle formation and deposition process and apparatus.

An exemplary in-situ particle formation and deposition process comprising the apparatus and method of the present invention is schematically shown in FIG. 4. The apparatus comprises additional fluid outlets to supply a first and a second composition separately.

In operation a first fluid, preferably containing one or more beneficial agents, is fed into first inlet 145 and a second fluid, generally composed of film-forming or adhesive components like polymers, is supplied to a second fluid inlet 135. The first fluid exists from central fluid orifice 15 surrounded by second orifice 136 through which the second fluid 135 is expelled. The atomizing gas exiting gas orifice 16 disintegrates both fluids. A spray plume 57 is formed from particles of the first fluid comprising the beneficial agent 140 and of the second fluid comprising the polymeric component 130. The spray plume 57 is surrounded by a second gas stream 123 that is supplied to second gas inlet 122 and exits annulus 125. The particles of the first fluid comprising the drug 140 are concentrated in the center of the spray plume. The particles formed by the second fluid 130 are concentrated at the spray boundary as visualized by particle trajectory 56. A three-dimensional structure with an embedded therapeutic agent is formed onto the substrate 54.

Figure 5A:
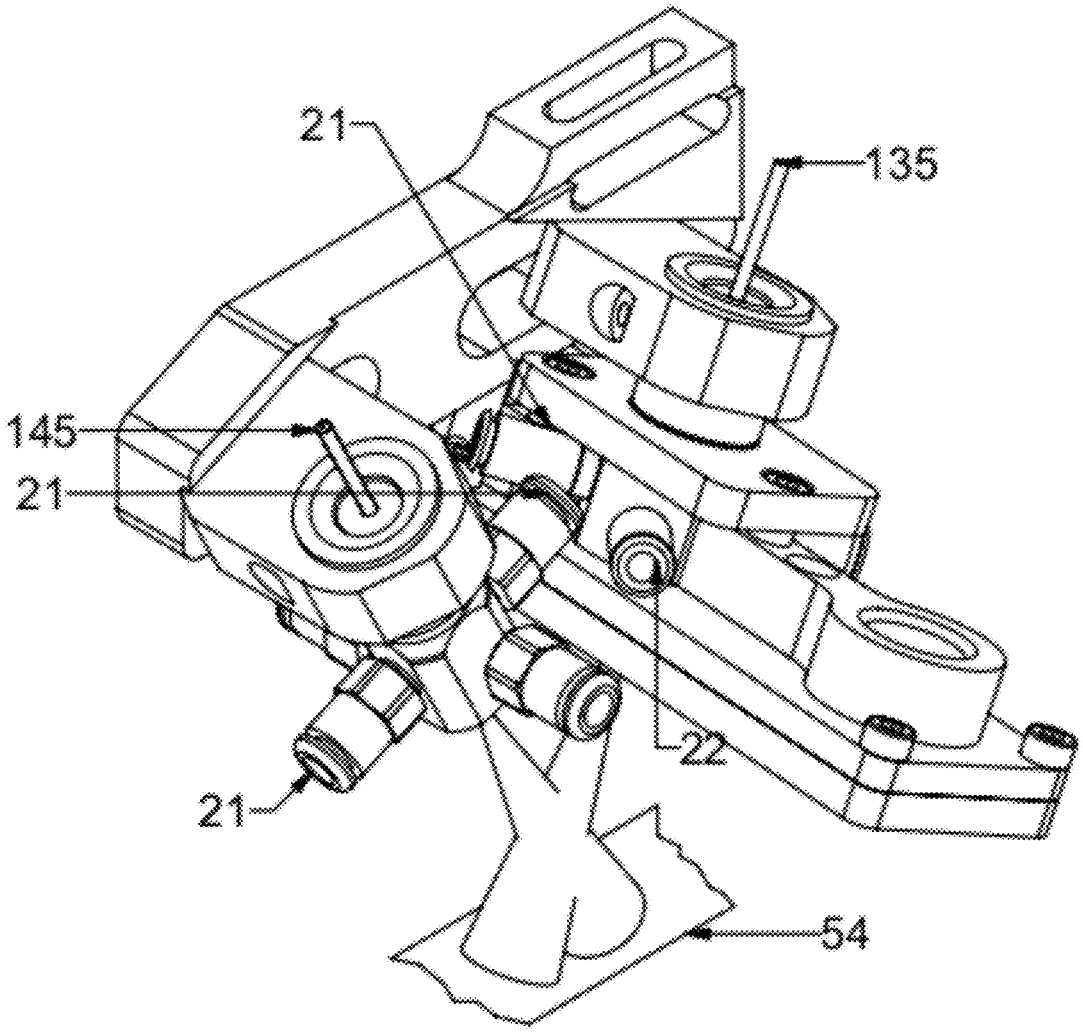
FIG. 5A is a perspective view of an alternative formation and deposition process setup.
Figure 5B:
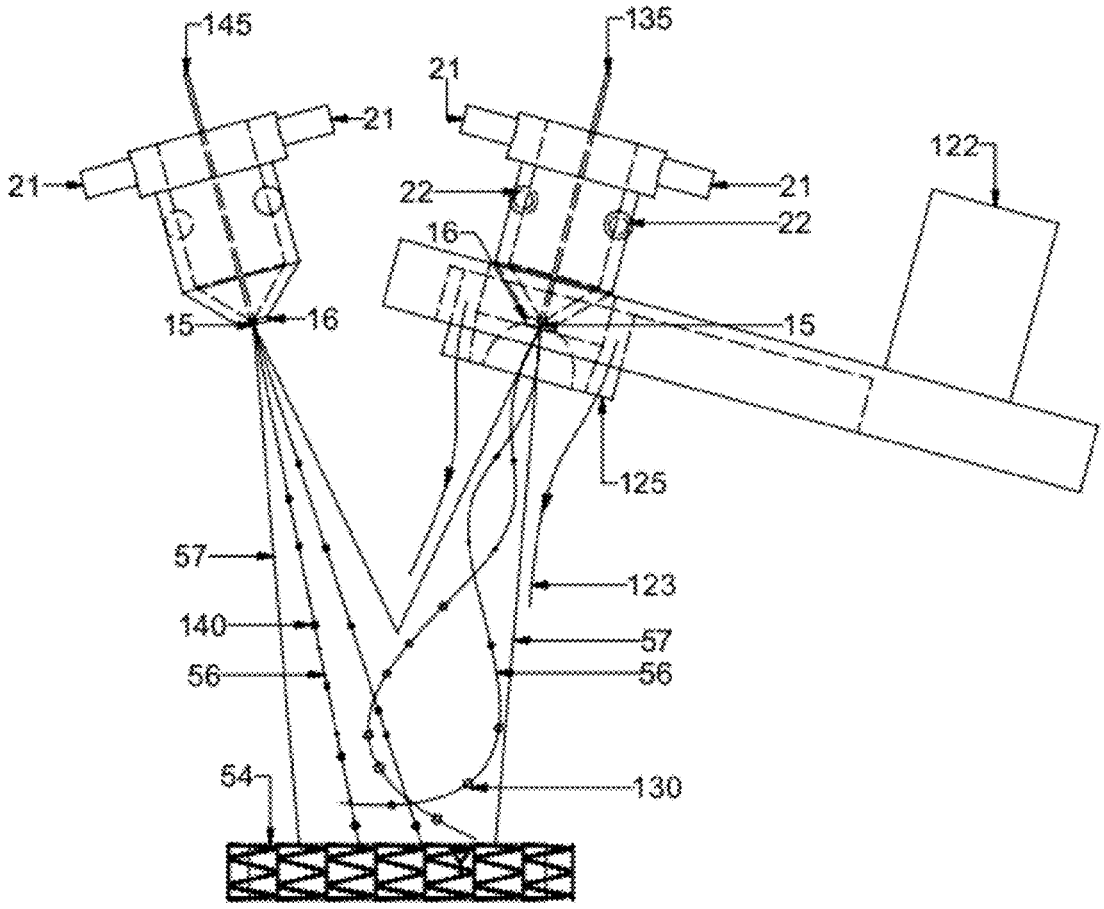
FIG. 5B is a particle formation and deposition process of FIG. 5A.

An alternative exemplary particle formation and deposition process is depicted in FIG. 5B. Two spraying devices are aligned at an angle of about 30 degree with respect to each other so that the spray plumes mix before contacting the substrate 54. FIG. 5A is a perspective view of FIG. 5B showing the particle formation and deposition setup in more detail.

In operation, a first fluid comprising a beneficial substance is fed into the first fluid inlet 145 and a second fluid containing a film-forming component, such as a biocompatible polymeric substance, into the second fluid inlet 135. The beneficial substance may be supplied in crystalline form (dry powder in a gaseous fluid or dispersion in a compatible liquid) and/or amorphous drug particles may be produced by dissolving the drug in a suitable solution. The beneficial substance may also be comprised of living cells suspended in a suitable solution. The first and second compositions are separately atomized into particles by an atomizing gas is fed respectively into inlets 21 and 22 and two spray plumes 57 are formed. The particles of the film-forming component 130 comprise a tangential velocity component, visualized by particle trajectory 56, resulting in a spray plume 57 of comparatively low axial velocity that is directed to the substrate 54. The spray 57 is surrounded by a second gas stream 123 flowing from inlet 122 to outlet 125 having a temperature that is preferably higher than the ambient temperature. The particles of the beneficial substance 140 are sprayed at a relatively high velocity (schematically visualized by particle trajectory 56, to ensure proper penetration of the drug particles 140 into the polymeric matrix.

The operating parameters of the spraying process are adjusted to ensure good coating integrity and homogeneous embedding of the beneficial substance in the polymer matrix.

Figure 5C:
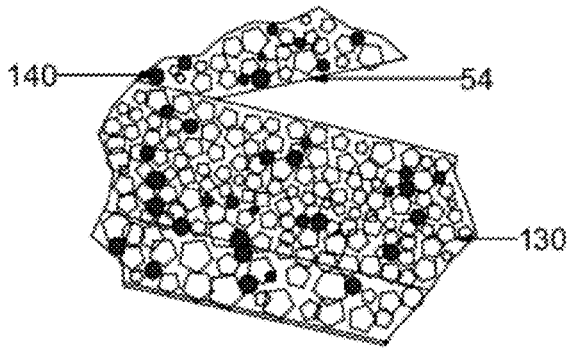
FIG. 5C is a schematic representation of a drug coating on a substrate.

The resulting coating matrix with the embedded drug particles is schematically visualized in FIG. 5C. It can be seen that the drug (black circles) is incorporated into the polymer (weight polygons).

The invention allows for controlled fluid mixing and evaporation. This ensures not only a reproducible and homogeneous deposition, but also comparatively high coating transfer efficiencies required, among others, for the mass production of medical devices and the application of wound dressings. The particle formation and deposition process of the present invention may also be employed to atomize a two component system, which may comprise a non-polymeric fibrin-related protein and a component for converting the fibrin-related protein to fibrin polymer, for forming a fibrin polymer on a tissue surface and/or to provide a coating of a biodegradable polymer that allows the adherence and infiltration of desired cells.

Although some embodiments are shown to include certain features, the applicant specifically contemplates that any feature disclosed herein may be used together or in combination with any other feature on any embodiment of the invention. It is also contemplated that any feature may be specifically excluded from any embodiment of an invention. Many variations of the invention will occur to those skilled in the art. Some variations include additional outlets for in-situ mixing of more than two fluids (e.g., for additionally providing a cell preparation useful for tissue regeneration) and/or supply of additional conditioned gas streams, and the like.

The following examples are presented to illustrate the advantages of the present invention. These examples are not intended in any way otherwise to limit the scope of the disclosure.

Medical Device Coating

Stents having a diameter of 1.6 mm and a length of 20 mm and medical tubes having a diameter of 3 mm and a length of 18 mm were mounted on a holding device, as described in U.S. patent application No. 60/776,522, incorporated herein as a reference. A coating composition including several biocompatible polymers and a solvent was applied to the devices using the apparatus of the present invention (Example 1 and Example 3). At least an additional liquid composition, typically comprising one or more beneficial agents and compatible solvents, was supplied simultaneously with the first liquid composition through a separate conduit to allow in-process mixing of polymer and beneficial agent (Example 2).

When coating comparatively small medical implants such as arterial stents, the distance between fluid outlet and substrate should be generally less than 100 mm and more preferably smaller than 60 mm to minimize spreading of the spray cone and maintain acceptable transfer efficiencies. Distances of more than 60 mm will generally result in poor coating quality and transfer efficiency, since the spray plume diverges and the spray density as well as the particle impulse forces decrease considerably. In this example, the spraying device was aligned in relation to the stent and positioned at a distance of approximately 45 mm from the stent, where the percentage of the submicron sized particles was more than 20%.

Since particle size and velocity is an important factor influencing solvent evaporation and film forming, the particle size and particle velocity should be relatively low. In this example, the initial median particle size of the solvent fraction was around 3 microns or less 10 mm downstream from the fluid orifice.

A syringe pump (Hamilton Inc., Reno, NEV., USA) was used to feed the fluid composition from a reservoir to the spraying device. The flow rate of the fluid composition may range between 0.5 ml/h and about 50 ml/h and the atomizing pressure between 0.3 to about 1.2 bar. Typically, a small amount of anti-clogging liquid is supplied during the spraying operation to control the local environment around the liquid orifice and prevent solid build-up.

During the application of the coating rotary motion was transmitted to the devices to rotate them about their central longitudinal axis. The devices were rotated at 130 rpm and translated along their central longitudinal axis along the spraying device at a translation speed of 2 mm/s and moved along the spraying device. The coating process was continuously monitored using a spray diagnostic system as described in U.S. patent application No. 60/674,005 incorporated by reference herein to monitor and control the atomization process.

Coating Example 1

A stent was coated using a composition comprising a first film-forming component (poly(butyl methacrylate) dissolved in a volatile solvent (tetrahhydrofuran) at a concentration of 13 mg/ml and a second film-forming component (polyethylene-co-vinyl acetate) with 40% vinyl acetate dissolved at a concentration of 23 mg/ml. The polymer composition was fed at a flow rate of 2 ml/h and gas was fed at a flow rate of 6.8 l/min and at an atomizing pressure of 1 bar. The coating was applied in several passes using the apparatus of the present invention as described before.

Figure 6A:
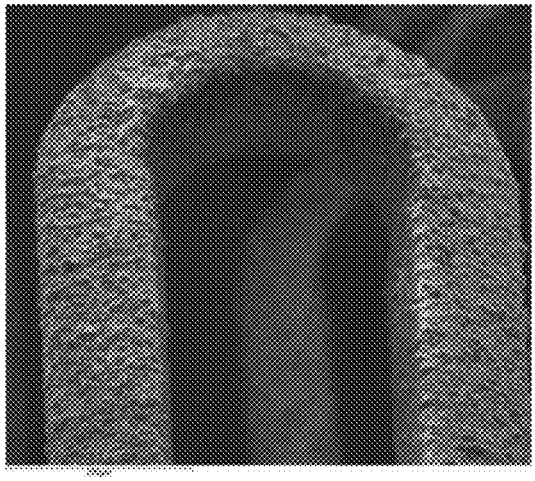
FIG. 6A is a SEM image (magnification 180x) of a coated portion of a stent.
Figure 6B:
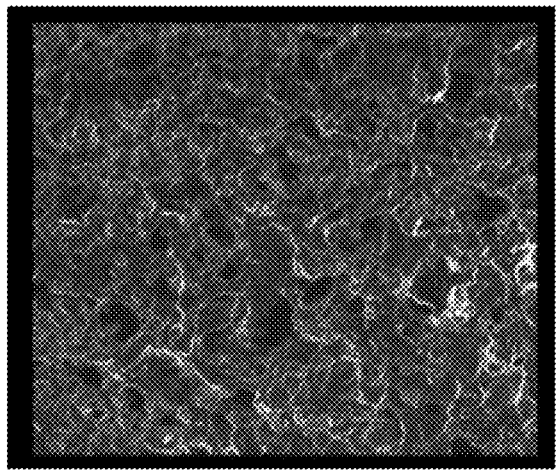
FIG. 6B is a SEM image (magnification 500x) of FIG. 6A.
Figure 6C:
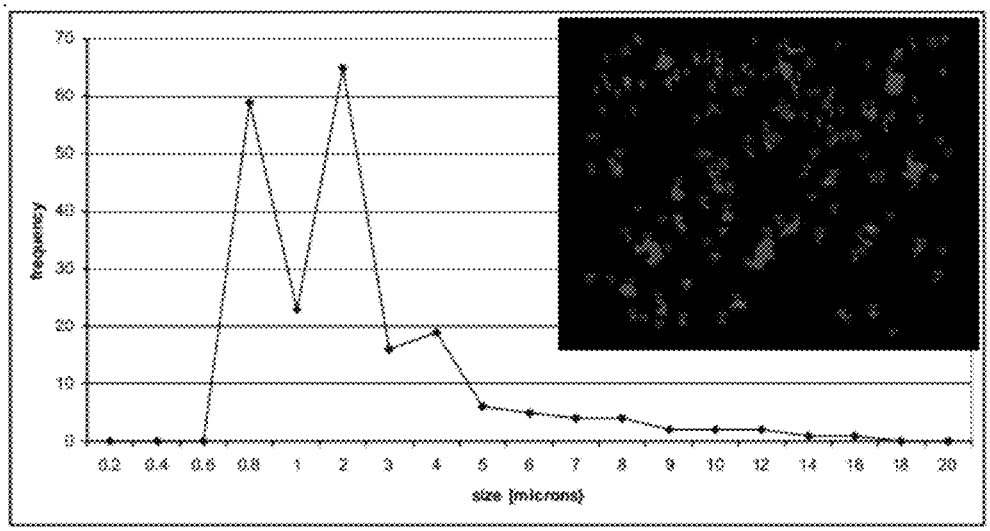
FIG. 6C is a surface feature analysis of FIG. 6B.

FIGS. 6A and 6B, show a portion of a stent strut comprising a near-dry textured coating. The surface was visualized by scanning electron microscopy (SEM). FIG. 6B depicts a higher magnification (500x) of the stent coating of FIG. 6A visualizing the surface features in more detail. The texture (elevations and cavities) is clearly visible on the entire surface of the strut. The surface structure of the coating layer comprises elevations (bright areas) and cavities or pores (dark areas) that are visible on the entire surface. The size of the features has been determined with an image analysis technique. FIG. 6C represents a binary image computed from the micrograph of FIG. 6B and a chart showing the size of the visible surface features. The most common feature size ranges between 600 nm and 4 microns and between 800 nm and 2 microns. Thus, a nano-micro coating was produced on the substrate comprising cavities that may be filled with a therapeutic agent to increase drug load and improve drug delivery.

The weight of the uncoated device (bare metal stent) was 19295 micrograms before application of the coating. Directly after application of the coating the weight of the coated device was 19782 micrograms (coating weight 487 μg). After 24 hours a weight of 19778 micrograms (coating weight 483 μg) was measured, which translates in a weight reduction of 4 micrograms.

The results demonstrate the efficiency of the solvent evaporation during the spraying process, which is the presumption for producing near-dry coatings and for an efficient elimination of solvent residuals that may negatively affect the performance of the medical device due to decreased biocompatibility. A stent comprising a near-dry nano-micro structured coating on the entire surface was produced with surface features ranging between 600 nm and 4 microns.

Coating example 2

A drug and a polymer composition were prepared, atomized and mixed in-situ using two spraying devices. The polymer composition was comprised of 13 mg/ml (poly(butyl methacrylate) and 23 mg/ml Polyethylene-co-vinyl acetate (PEVA) with 40% vinyl acetate dissolved in tetrahydrofuran. The drug composition was comprised of rapamycin dissolved in ethanol. The drug composition was fed at a flow rate of 2 ml/h and gas was fed at a flow rate of 5.4 l/min into the first spraying apparatus. The polymer composition was supplied at a flow rate of 2 ml/h and gas was fed at a flow rate of 6.8 l/min into the second spraying apparatus. The drug and polymer composition were disintegrated separately. The solvents were evaporated and a textured near-dry coating comprising cavities with an embedded drug component was formed on the stent.

Coating Example 3

A first composition comprising a mild hydrophobic polymer (polyethylene-co-vinyl acetate) dissolved in THF and a second composition comprising a hydrophilic polymer (PVP) dissolved in ethanol were used to coat several medical tubes according to the method and apparatus of the present invention.

The first composition was fed in a first spraying apparatus at a flow rate of 2 ml/h and was disintegrated by a gas stream which was supplied to the spraying apparatus at a flow rate of 6.8 l/min. The second composition was fed into a second spraying apparatus at a flow rate of 2 ml/h and was disintegrated by a gas stream which was supplied to at the spraying apparatus a flow rate of 5.4 l/min. Three medical tubes were coated with the first composition and three with the second composition. Near-dry coatings having a nano-micro structure were produced.

To obtain information on the surface properties (wettability), a water drop was dispensed on the surface of the coated substrates. Pictures were taken with a digital microscope and analyzed using an image analysis software to measure the actual contact angle between the surface and the surface of a liquid particulate on the surface. It has been found that the contact angle could be fine-tuned using the method and apparatus of the present invention without changing the chemistry. For PEVA contact angles ranging from 110° to about 140° were obtained. Thus, the surface properties in terms of hydrophobicity could be altered. In contrast, reduced contact angles were obtained for PVP resulting in an increased hydrophilicity.

The apparatus and method of the present invention is suited for drug delivery applications, e.g., for producing drug-eluting coatings on medical implants or sprays for inhalation and drug deposition in the nasal cavity or lung. The rapid formation of coatings allows films to be easily formed on vertical surfaces or in difficult to reach irregular spaces, such as within cavities of patients. In addition, three-dimensional synthetic coatings or tissues, which may comprise cells, having various thicknesses can be formed. The permeability of the coating may be altered to allow nutrients diffusion and improved healing.

With the apparatus and method a film-forming component (matrix) and a beneficial agent may be fine-tuned to obtain a desired drug release and to improve the bioavailability of the drug. A conditioned gas stream is preferably provided for shielding the drug particles or composition from external influence factors and/or fine-tuning the morphology of the drug by increasing the solvent evaporation. The simultaneous disintegration of the film-forming component with the drug ensures proper embedding of drug particles so that a homogeneous drug distribution is insured. One or more drugs having a defined morphology (crystalline and/or amorphous) may be embedded in the matrix.

The results show that porous coatings for higher drug load may be formed. In addition, the surface properties, namely the hydrophobicity and hydrophilicity, of the coating layer can be manipulated by altering the amount of submicron sized droplets of the volatile component, the particle velocity and particle impact angle and thereby influencing the particle deposition process. Thus, "biomimicking" drug-eluting coatings that could prove useful for tuning bioadhesion may be produced.

Desired cell adhesion, bacterial adhesion, wettability (hydrophilicity/hydrophobicity) and drug diffusion or release may be influenced using the apparatus and method of the present invention to improve the performance of medical devices for the particular application.

The invention claimed is:

1. A method to form a coating with surface features on a substrate comprising the steps of:

(a) providing a first liquid composition including at least a volatile component and at least a non-volatile component;

(b) providing at least an atomizing device having a first conduit for flowing said first liquid composition from a first liquid inlet to a first orifice and a second conduit for flowing a first gas stream from a second inlet to a second orifice;

(c) atomizing the liquid composition exiting the first orifice by the first gas stream which exceeds sonic speed while providing a second gas stream and flowing it from an additional conduit to a third orifice and directing said second gas stream so that it interacts with the first gas stream during atomization, and thereby increasing the temperature of at least a part of the first gas stream to a temperature higher than ambient temperature so that particles are formed from the non-volatile component of the liquid composition;

(d) depositing the particles to form a coating with three-dimensional surface features on the substrate.

2. The method according claim 1, wherein at least 20% of the droplets of the volatile component are submicron sized.

3. The method according claim 2, wherein the amount of submicron sized droplets is adjusted by varying the distance between the atomizing device and the substrate.

4. The method of claim 2, further comprising the step of:

adjusting the amount of submicron sized droplets by varying the temperature and/or flow rate of the second gas stream.

5. The method of claim 1, wherein the third orifice of the additional conduit at least partially surrounds the first and second conduits and the gas stream exiting the third orifice is inclined towards the first gas stream so that the heat transfer between the first and second gas streams is optimized.

6. The method of claim 1, wherein the coating is applied to a patient to promote wound healing and the coating comprises at least a layer with a therapeutic agent.

7. The method of claim 2, further comprising the steps of:

(a) providing at least an additional conduit;

(b) flowing a second liquid from an inlet to an outlet of said additional conduit;

(c) atomizing said second liquid into fine particles; and (d) embedding the particles from the second liquid in the coating.

8. The method according claim 7, wherein the second liquid comprises a therapeutic substance.

9. The method according claim 1, wherein the non-volatile component comprises a polymeric substance.

10. The method of claim 1, further comprising the steps of:

(a) inducing swirl motion in the first gas stream to obtain a vortical gas flow;

(b) transporting the particles to the substrate so that the majority of the particles have a tangential velocity component in relation to the surface of the substrate and an asymmetric splat morphology is produced upon deposition on the substrate.

11. The method of claim 1, wherein the first liquid composition is flown at a constant velocity from the first liquid inlet to the first orifice.

12. The method according claim 1, further comprising the step of heating the first liquid composition.

13. The method according claim 1, wherein the substrate is a medical device.

14. The method according claim 1, wherein the substrate is a tissue.

15. The method according claim 1, wherein the first liquid composition comprises a therapeutic substance.

16. The method of claim 1, wherein the coating consists of several layers that comprise pores and the coating has a three-dimensional structure.

17. The method of claim 16, wherein the pores are interconnected to allow beneficial agents or cells to penetrate through the coating layer.

18. The method according claim 1, wherein the coating comprises surface features having a size smaller than 20 microns.

19. The method of claim 18, wherein the surface features increase the hydrophobicity and/or hydrophilicity of the coating.

20. A method to form a coating with surface features on a substrate comprising the steps of:

(a) providing a first liquid composition including at least a volatile component and at least a non-volatile component;

(b) providing at least an atomizin device having a first conduit for flowing said first liquid composition from a first liquid inlet to a first orifice and a second conduit for flowing a first gas stream from a second inlet to a second orifice;

(c) atomizing the liquid composition exiting the first orifice while providing a second gas stream and flowing it from an additional conduit to a third orifice and directing said second gas stream so that it interacts with the first gas stream during atomization, and thereby increasing the temperature of at least a part of the first gas stream to a temperature higher than ambient temperature so that particles are formed from the non-volatile component of the liquid composition;

(d) depositing the particles to form a coating with three-dimensional surface features on the substrate wherein the coating consists of several layers that comprise pores and the coating has a three-dimensional structure with surface features having a size smaller than 20 microns.

* * * * *